US007171704B2

(12) United States Patent
Johnson

(10) Patent No.: US 7,171,704 B2
(45) Date of Patent: Feb. 6, 2007

(54) AUTOMATIC HAIR WASHING DEVICE

(76) Inventor: Ernest L. Johnson, 1755 Nicholson Dr., Baton Rouge, LA (US) 70802

( * ) Notice: Subject to any disclaimer, the term of this patent is extended or adjusted under 35 U.S.C. 154(b) by 0 days.

(21) Appl. No.: 10/715,584

(22) Filed: Nov. 18, 2003

(65) Prior Publication Data

US 2004/0148692 A1 Aug. 5, 2004

Related U.S. Application Data

(60) Provisional application No. 60/444,694, filed on Feb. 4, 2003.

(51) Int. Cl.
*A45D 19/00* (2006.01)

(52) U.S. Cl. ..... 4/518; 4/520; 4/523; 132/272

(58) Field of Classification Search ..... 4/515, 4/516, 518, 519, 520, 523; 132/271, 272
See application file for complete search history.

(56) References Cited

U.S. PATENT DOCUMENTS

| | | | | |
|---|---|---|---|---|
| 1,244,535 | A | 10/1917 | Nutter | |
| 4,073,438 | A | 2/1978 | Meyer | |
| 4,407,028 | A | 10/1983 | Nolan | |
| 4,771,487 | A * | 9/1988 | Little | 4/519 |
| 4,834,121 | A | 5/1989 | Bell | |
| 4,841,590 | A | 6/1989 | Terry et al. | |
| 5,010,604 | A | 4/1991 | Miller | |
| 5,842,239 | A * | 12/1998 | Eckelbarger | 4/523 |
| 5,906,012 | A * | 5/1999 | Sakane et al. | 4/519 |
| 6,092,739 | A | 7/2000 | Clearman et al. | |
| 6,249,922 | B1 | 6/2001 | Shimizu | |
| 6,291,051 | B1 * | 9/2001 | Shimizu | 4/520 X |
| 6,338,170 | B1 | 1/2002 | De Simone | |
| 6,460,783 | B1 | 10/2002 | Christopher | |
| 6,719,218 | B2 | 4/2004 | Cool et al. | |
| 6,730,051 | B2 | 5/2004 | Lin | |
| 2001/0001884 | A1 | 5/2001 | Miyoshi et al. | |
| 2002/0184703 | A1 * | 12/2002 | Minami | 4/515 |
| 2004/0261169 | A1 * | 12/2004 | Matsunaga et al. | 4/515 |

FOREIGN PATENT DOCUMENTS

| | | |
|---|---|---|
| EP | 0 965 285 A1 | 12/1999 |
| JP | 06217820 | 8/1994 |
| JP | 08150011 | 6/1996 |

* cited by examiner

*Primary Examiner*—Robert M. Fetsuga

(57) ABSTRACT

An automatic hair washing device including a basin having a hollow interior, a plurality of rotating nozzle assemblies rigidly connected to the interior of the basin for spraying a plurality of selected liquids onto the hair of the user of the automatic hair washing device of the invention, and a hood rotatably connected to basin, the hood having flexible face cover therein for covering the hair and ears of the user of the automatic hair washing device of the invention.

12 Claims, 4 Drawing Sheets

AUTOMATIC HAIR WASHING DEVICE

CROSS-REFERENCE TO RELATED APPLICATIONS

This application claims the benefit of the filing date and priority of provisional application Ser. No. 60/444,694 filed Feb. 4, 2003.

BACKGROUND OF THE INVENTION

1. Field of the Invention

The present invention relates to hair washing devices. In particular, the present invention is related to devices that automatically wash and rinse human hair.

2. Description of the Related Art

Devices for washing human hair are known in the art. Automatic devices for washing human hair are also known in the art.

Some of the devices of the prior art have a basin for holding the head of the user, and a cover for enclosing the hair of the user and with the face outside. These devices of the prior art may employ rotating manifolds for spraying liquids from stationary jets thereon onto the hair being washed. The manifolds are generally arcuate in shape.

Exemplary of the Patents of the related art are the following: U.S. Pat. Nos. 1,244,535; 3,521,647; 4,834,121; 4,407,028; 5,010,604; 5,906,012; and 6,249,922 B1; U.S. Patent Publications U.S. 2001/0001884 A1 and U.S. 2002/0184703 A1; Japan Publication Numbers 06217820 and 08150011; and European Patent Office EP 0 965 285 A1.

BRIEF SUMMARY OF THE INVENTION

In accordance with the present invention there is provided an automatic hair washing device including a basin having a hollow interior, a plurality of rotating nozzle assemblies rigidly connected to the interior of the basin for spraying a plurality of selected liquids onto the hair of the user of the automatic hair washing device of the invention, and a hood rotatably connected to the basin, the hood having flexible face cover therein for covering the hair and ears of the user.

DETAILED DESCRIPTION OF THE INVENTION

The present invention provides an automatic hair washing device which sprays shampoo, hair conditioner, and rinse water to the hair of the user through rotating nozzle assemblies fixed to the inside of a basin. A face and neck cover is provided to ensure liquid passage to the side of the neck, front of the ear and forehead of the user. Proper drainage under all conditions is accomplished by an overflow drainage outlet in the basin beneath the level of the head of the user. A manual cut-off device is provided for supplementary and finish washing. The basin receives the head and neck of the user at angle of approximately 45 degrees with the horizontal to provide comfort during washing without having the user lie in a supine or horizontal position.

Figure 1:
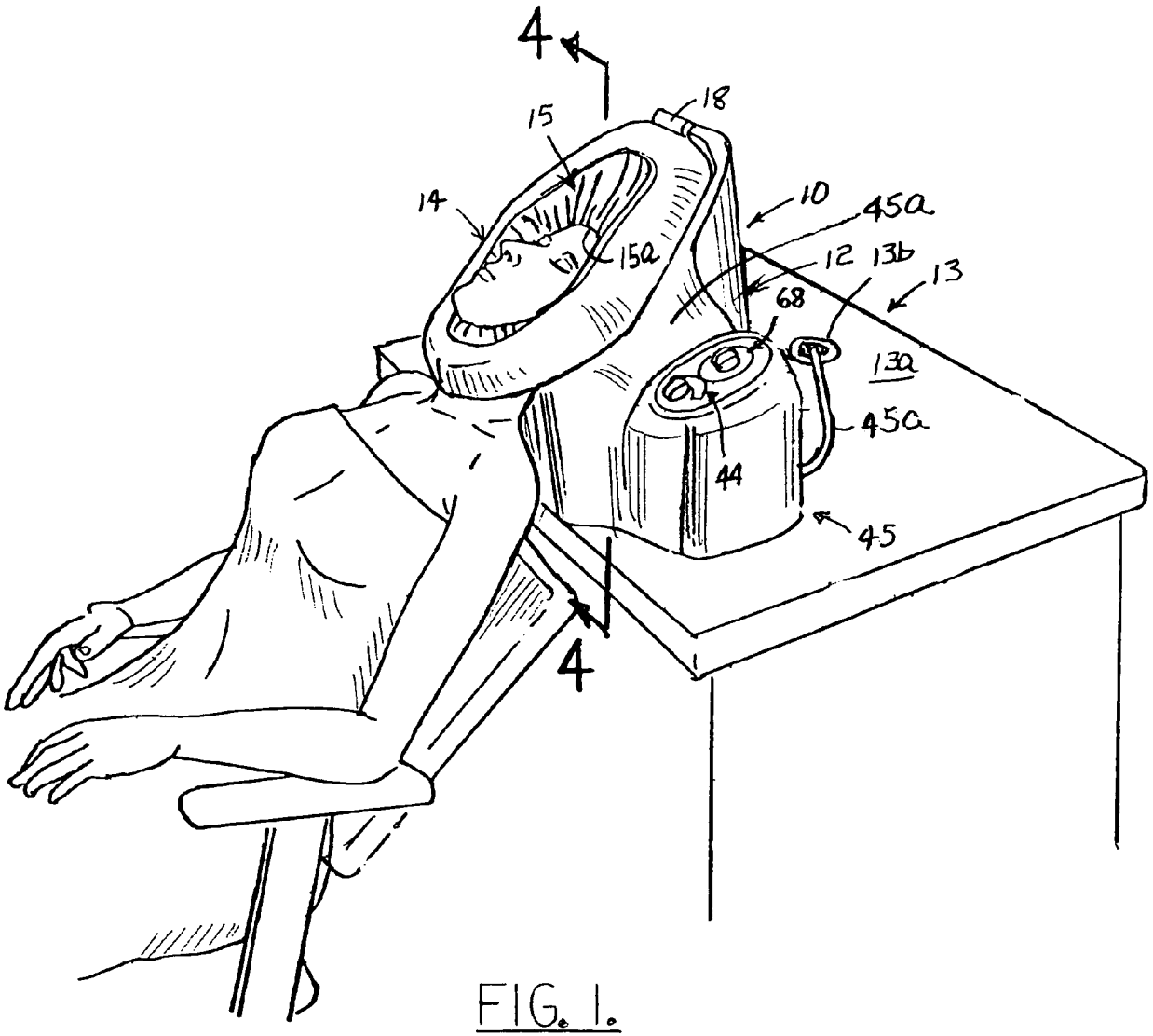
FIG. 1 is a partly cut-away perspective view of a person washing their hair in the automatic hair washing device of the invention with a hinged hood placed around the person's face.
Figure 2:
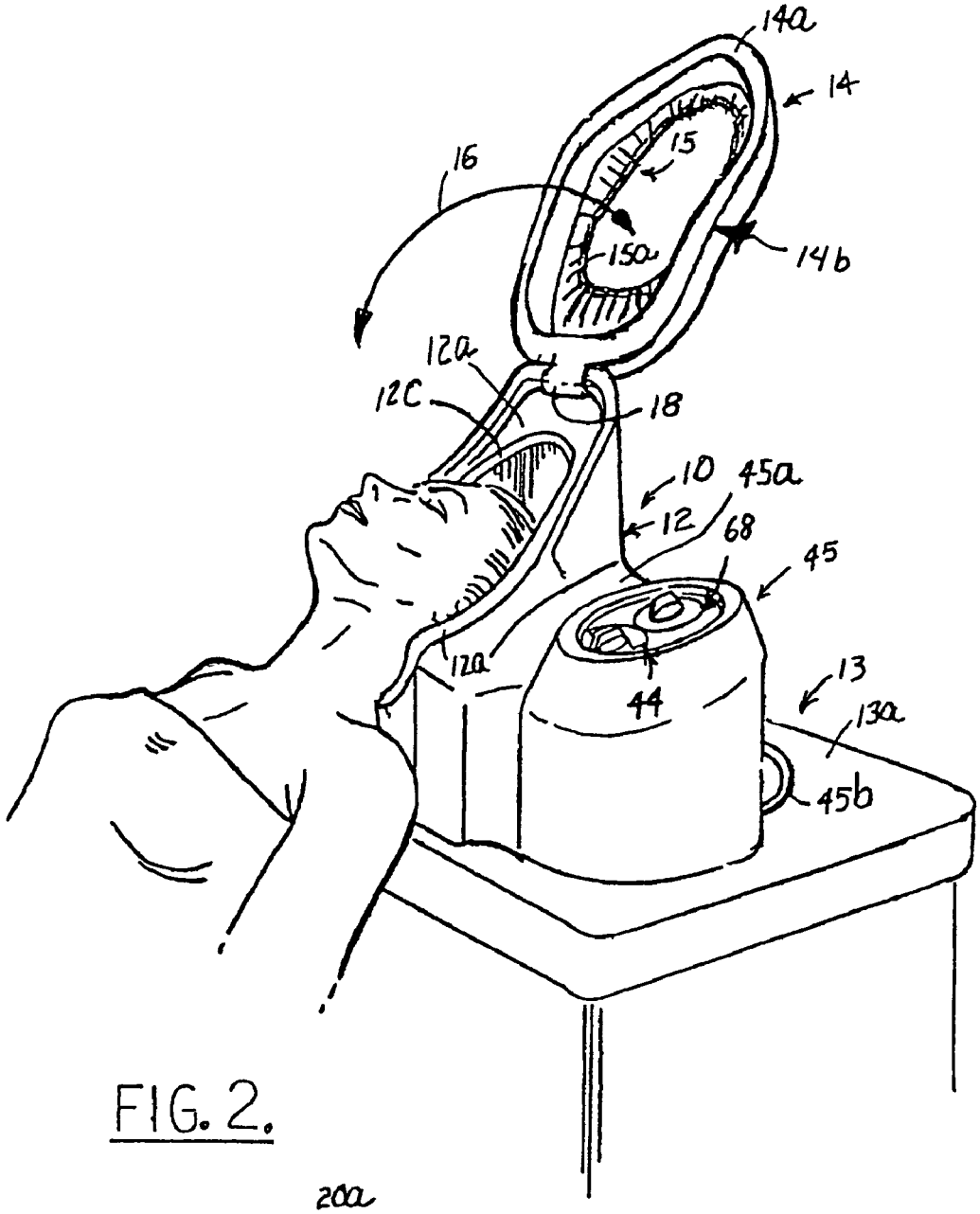
FIG. 2 is a partly cut-away perspective view of a person utilizing the automatic hair washing device of the invention with the hinged hood in the open position.
Figure 4:
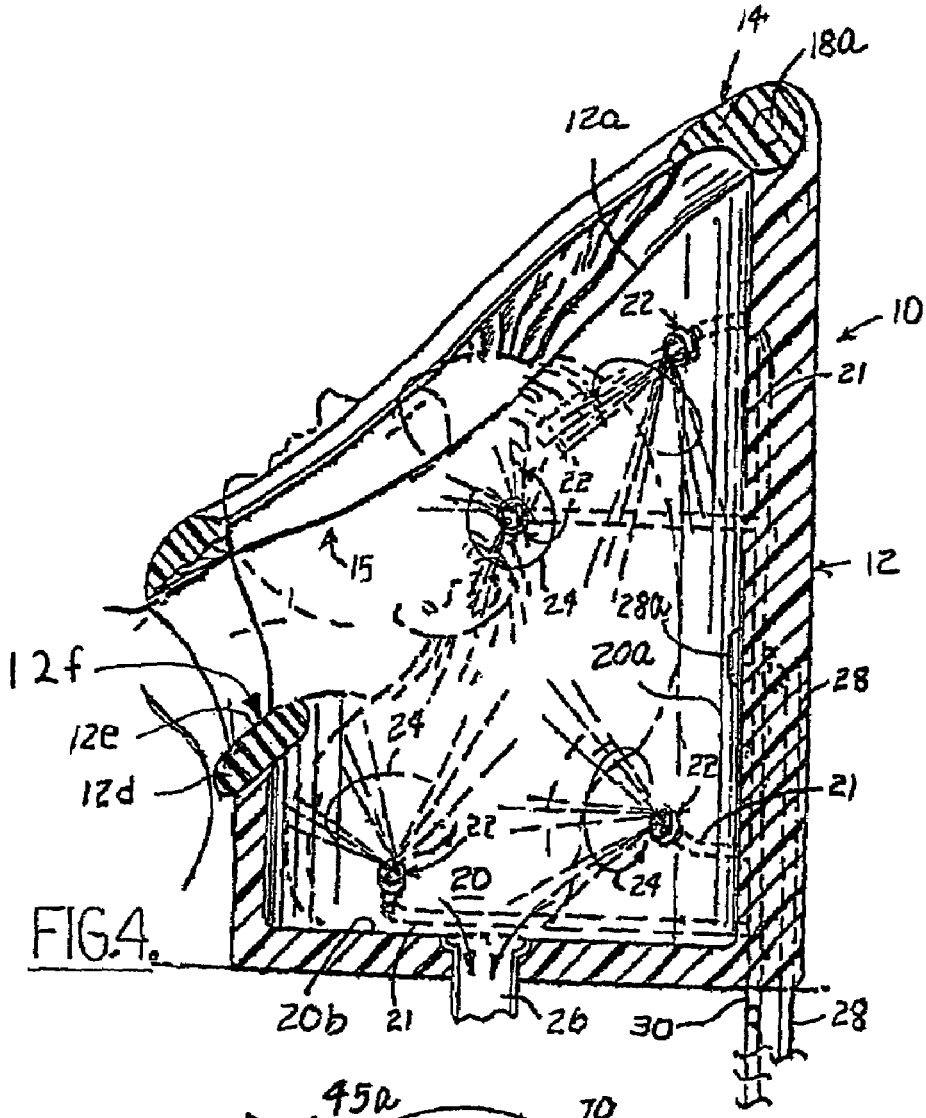
FIG. 4 is a cross-sectional view taken along lines 4—4 of FIG. 1.

Referring now to the drawings, and in particular to FIG. 1, the automatic hair washing device of the invention is generally indicated by the numeral 10. Washing device 10 includes a basin generally indicated by the numeral 12 having a unique pivotal hood generally indicated by the numeral 14 for selectively covering the hair and ears and exposing the face of the person utilizing the device 10 of the invention. Basin 12 preferably sits upon the top 13*a* of the cabinet generally indicated by the numeral 13. Hood 14 pivots in the directions indicated by the double-headed arrow 16 in FIG. 2, and is rotatably connected to basin 12 by hinge 18. As shown in FIGS. 2 and 4, hinge 18 rotates about a horizontal pin 18*a* connected to the top of basin 12.

Hood 14 has an outer edge 14*a* which preferably has a soft sealing surface 14*b* which forms a water tight seal with the upper surface 12*a* of basin 12 and the neck of the user. Upper surface 12*a* has an opening 12*c* which receives the head and hair of the user.

Hood 14 has a unique flexible face cover generally indicated by the numeral 15 connected thereto. Flexible face cover 15 has an elastic inner edge 15*a* which can be stretched over the face of the person utilizing the device 10 of the invention to prevent liquids sprayed onto the hair from flowing under the Inner edge 15*a* onto the face and eyes of the person utilizing the device 10 of the invention. The face of the user is exposed between the inner edge 15*a*, and the ears of the user are is covered by inner edge 15*a*.

Basin 12 has a generally cylindrical interior basin generally indicated by the numeral 20. Basin 12 has a neck support 12*d* which has an inner flat surface 12*e* inclined at an angle of about 45 degrees with the horizontal. The neck support 12*d* of basin 12 receives the head and neck of the user at angle of approximately 45 degrees with the horizontal to provide comfort during washing without having the user lie in a supine or horizontal position. Neck support 12*d* is covered with a soft, flexible material 12*f* which forms a liquid seal with the neck.

Figure 6:
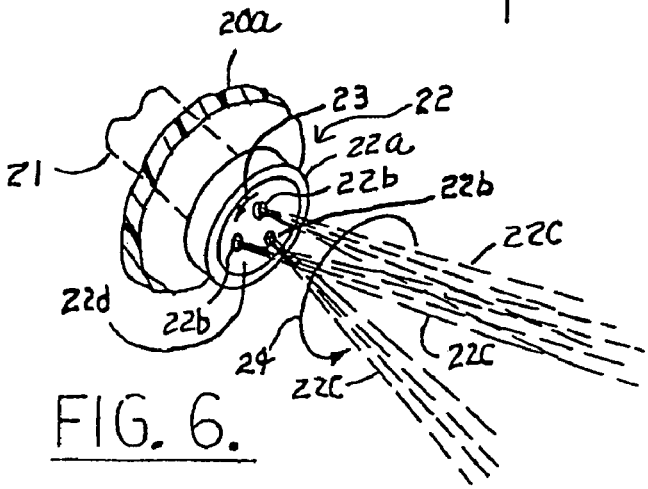
FIG. 6 is a detailed view of one of the spray nozzles of the invention.

As shown in FIGS. 4 and 6, basin 12 has a plurality of nozzle assemblies generally indicated by the numeral 22 rigidly connected to the interior wall 20*a* of interior basin 20 which are directed toward the hair of the user. Preferably eight nozzle assemblies 22 are employed having three rotating jets 22*b* tenon are utilized, with four of the nozzle assemblies 22 being shown in the cross-sectional view of FIG. 4. The opposite side of interior basin 20 and nozzles 22 are identical to those shown in FIG. 4. The nozzle assemblies 22 are positioned on the interior wall 20*a* of basin 12 to ensure that the entire amount of hair of the user is sprayed by nozzle assemblies 22.

A preferred nozzle assembly 22 is shown in detail in FIG. 6. Liquids are supplied to nozzle assembly 22 by pipe 21.

Nozzle 22 has a stationary circular housing 22*a* rigidly connected to the inner wall 20*a* of basin 12. Each jet 22*b* is rigidly connected to a rotating disc 22*d*. Rotating disc 22*d* rotates as indicated by the arrow 23 in FIG. 6. Preferably there are three jets 22*b* in each rotating disc 22*d*. The streams of liquid 22*c* exiting from jets 22*b* rotate as indicated by the mow 24 in FIGS. 4 and 6 to insure a thorough wetting, washing, conditioning and rinsing of the hair of the person utilizing the automatic hair washing device 10 of the invention. Each jet 22*b* is rigidly connected to a rotating disc 22*d* of device 10 of the invention.

Rotating nozzle assemblies 22 ensure thorough application of liquid shampoo, hair conditioner, and water to the hair of the user. As shown in FIG. 4, the rotating nozzle assemblies 22 are rigidly connected to the interior wall 20*a* of basin 12 to provide a massaging action to the hair and scalp of the user for thorough cleansing, conditioning, and rinsing. Liquids sprayed from nozzles 22 flow by gravity into the bottom 20*b* of interior basin 20. Liquids flowing into the bottom 20*b* of interior basin 20 exit interior basin 20 through drain pipe 26, conventional curved drain trap pipes 26*a* and 26*b*, pipes 26*c* and 26*d*, to an existing sewer line as shown in FIG. 3.

An overflow pipe 28 having entrance 28*a* in basin interior wall 20*a* located above basin bottom 20*b* is provided to provide additional drainage in the event that drain pipe 26 becomes plugged with loose hair or other debris. The entrance 28*a* to overflow pipe 28 is preferably located at the approximate distance of the bottom of the head of the person utilizing the device 10 of the invention. Overflow pipe 28 is connected to drain pipe 26 as shown in FIG. 3 above drain trap pipe 26*a* to convey any liquids flowing through overflow pipe 28 through drain trap pipes 26*a* and 26*b* prior to flowing through pipes 26*c* and 26*d* to an existing sewer line.

Liquids are supplied to nozzles 22 through pipes 21 which are connected to main supply pipe 30. Main supply pipe 30 may receive water from water supply pipe 32, and shampoo and/or hair conditioner from secondary supply pipe 34.

Figure 3:
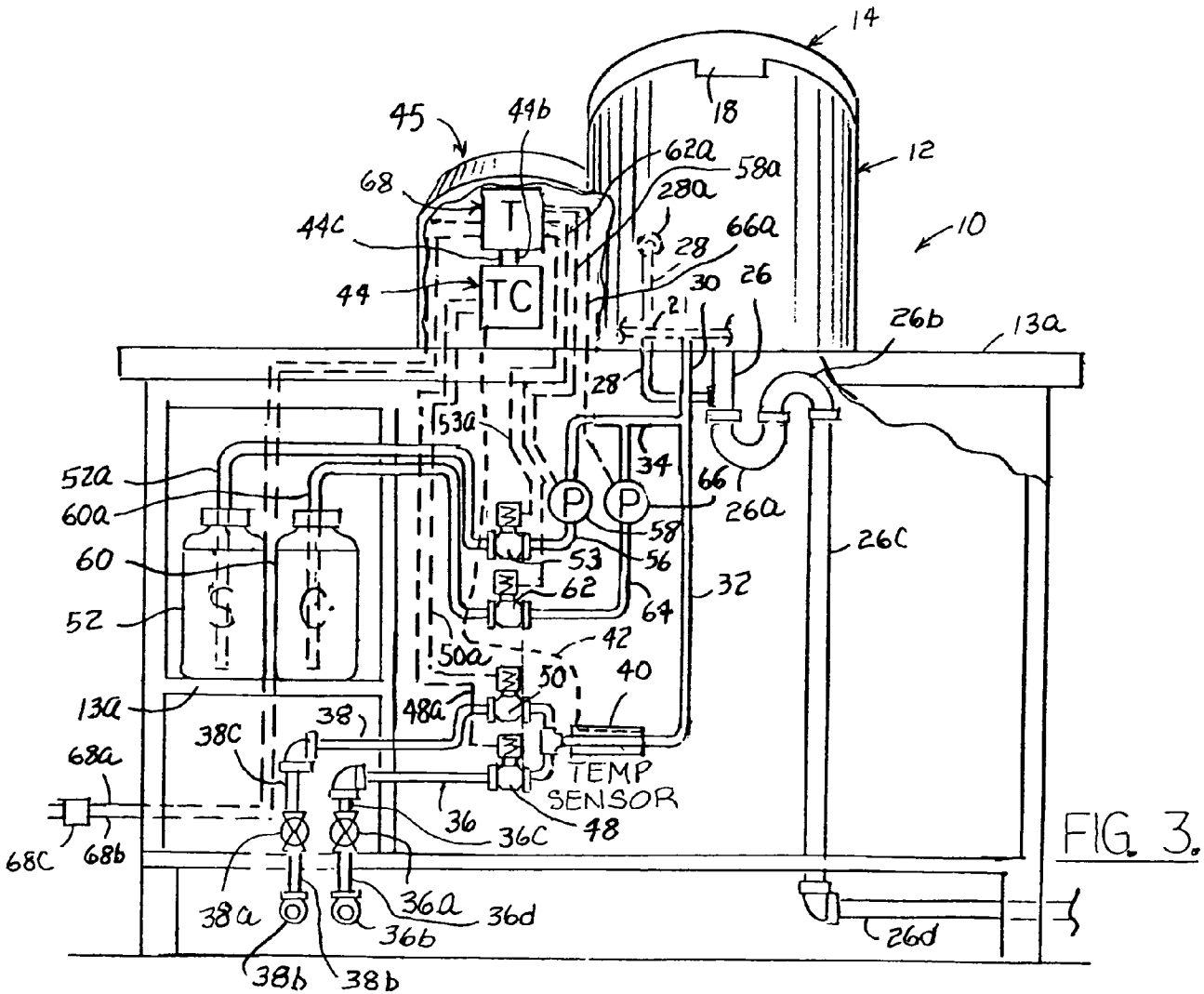
FIG. 3 is a partly cut-away partly schematic elevational view of the back side of the cabinet of the automatic hair washing device of the invention.

As shown in FIG. 3, water is supplied to water supply pipe 32 from hot water supply pipe 36 and cold water supply pipe 38. A hot water supply valve 36*a* and a cold water supply valve 38*a* are provided to selectively connect or disconnect hot water from a hot water source 36*b* and cold water from a cold water source 38*b* to hot water supply pipe 36 and cold water supply pipe 38.

Valve 36*a* is connected to hot water supply pipe 36 by pipe 36*c* and valve 38*a* is connected to cold water supply pipe 38 by pipe 38*c* to enable hot water to shut off when device 10 is not in use. Valve 36*a* is connected to hot water source 36*b* by pipe 36*d* and valve 38*a* is connected to cold water source 38*b* by pipe 38*d* to enable cold water to be shut off when device 10 is not in use. Hot water source 36*b* may be a conventional hot water tank (not shown) and cold water source 38*b* may be a convention municipal water source, or a well.

Figure 5:
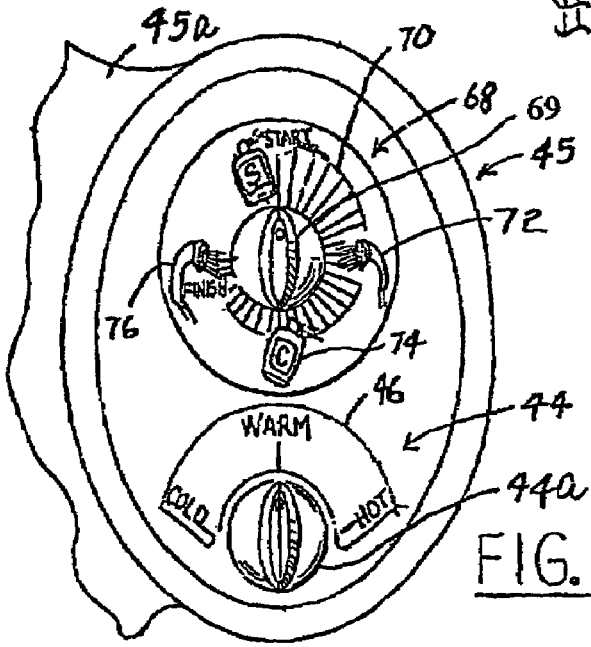
FIG. 5 is a partly cut-away plan view of the control apparatus of the invention.

The temperature of the water flowing through water supply pipe 32 is monitored by a conventional temperature sensor 40 well known in the art labeled "TEMP SENSOR" in FIG. 3. An electrically conductive wire 42 extends from temperature sensor 40 to a conventional water temperature control device generally indicated by the numeral 44 labeled "TC" in FIG. 3. Water temperature control device 44 is located in the control console generally indicated by the numeral 45, which is preferably connected to basin 12 by joining member 45*a*. As best shown in FIG. 5, water temperature control device 44 has a rotatable dial 44*a* thereon which cooperates with a scale 46 thereon to enable the temperature of water entering pipe 32 to be varied as desired.

The temperature of water entering water supply pipe 32 is varied by solenoid operated valve 48 which is connected to hot water supply pipe 36 and controls the volume of hot water flowing therefrom into water supply pipe 32, and by solenoid operated valve 50 which is connected to cold water supply line 38 and controls the volume of hot water flowing therefrom into water supply pipe 32. Solenoid operated valve 48 receives an electrical signal through electrically conductive wire 48*a* connected thereto and to water temperature control device 44, and solenoid operated valve 50 receives an electrical signal through electrically conductive wire 50*a* connected thereto and to water temperature control device 44, both of which electrical signals control the relative volume of the flow of hot and cold water flowing through valves 48 and 50, respectively, and thus control the temperature of the water in water supply pipe 32 through the controlled blend of hot and cold water.

Shampoo is contained in vessel 52 labeled "S" in FIG. 3 which preferably is contained inside of cabinet 13 and sits upon shelf 13*c* in cabinet 13. Shampoo from vessel 52 is pumped from vessel 52 through conduit 52*a*, through solenoid operated valve 53, and through pipe 56 by pump 58 into secondary supply pipe 34. Solenoid operated valve 53 receives an opening and closing electrical signal through electrically conductive wire 53*a* connected thereto and to the timing and selection device generally indicated by the numeral 68 and labeled "T" In FIG. 3, and pump 58 receives an activating and deactivating electrical signal through electrically conductive wire 58*a* connected thereto and to the timing and selection device 68. Electrical energy is supplied to selection device 68 through electrically conductive wires 68*a* and 68*b* and electrical plug 68*c* and to water temperature control device 44 by electrically conductive wires 44*b* and 44*c* extending from timing and selection device 68.

Timing and selection device 68 is located in the control console generally indicated by the numeral 45. As best shown in FIG. 5, timing and selection device 68 has a rotatable dial 69 thereon which cooperates with a scale 70 thereon to indicate which liquid is being applied to the hair, such as shampoo mixed with water at the "START" position on scale 70, pure water during the rinse cycle as indicated by the hand-held spray nozzle 72 on scale 70 to remove shampoo from the hair, conditioner after rinsing with pure water as indicated byte bottle 74 on scale 70 having the label "C" thereon, and a final rinsing as indicated by the hand-held spray nozzle 76 on scale 70. Preferably, a clock is built into timing and selection device 68 to provide washing, hair conditioning, and rinsing according to a pro selected timing cycle. Timing and selection device 68 may be reset manually for providing for supplementary rinsing, conditioning, and finish washing by resetting dial 68*a* after a complete cycle.

As shown in FIG. 3, hair conditioner is contained in vessel 60 labeled "C" which preferably is contained inside of cabinet 13 and sits upon shelf 13*c* in cabinet 13 adjacent to vessel 52. Hair conditioner from vessel 60 is pumped through conduit 60*a*, through solenoid operated valve 62, and through pipe 64 by pump 66 into secondary supply pipe 34. Solenoid operated valve 62 receives an opening and closing electrical signal through electrically conductive wire 62*a* connected thereto and to the timing and selection device generally indicated by the numeral 68 and labeled "T" in FIG. 3, and pump 66 receives an activating and deactivating electrical signal through electrically conductive wire 66*a* connected thereto and to the timing and selection device 68.

Each of the electrically conductive wires 48*a*, 50*a*, 53*a*, 58*a*, 62*a* and 68*a* are preferably bundled into cable 45*b* Cable 45*b* extends from control console 45 through opening 13*b* in the top 13*a* a of cabinet 13.

As shown above, shampoo, hair conditioner and water at a desired temperature can be applied and repeated as desired by appropriate adjustment of temperature control device 44 and timing and selection device 68. The stationary nozzle assemblies 22 of the invention provide thorough and soothing application of shampoo, hair conditioner, and rinse water to the hair of the user.

Although the preferred embodiments of the invention have been described in detail above, it should be understood that the invention is in no sense limited thereby, and its scope is to be determined by that of the following claims:

What is claimed is:

1. An automatic hair washing device comprising;

a) a basin having a hollow interior, b) a plurality of nozzle assemblies rigidly connected to the interior of the basin which nozzle assemblies are configured for spraying liquid onto the hair of the user of the hair washing device in rotating streams, wherein each of the nozzle assemblies is comprised of a rotating disc which rotates in the assembly as liquid is sprayed therefrom, and c) a hood for covering the hair and ears of the user while exposing the face of the user which hood is connected to the basin.

2. The automatic hair washing device of claim 1 wherein the liquid comprises water, shampoo, and/or hair conditioner.

3. The automatic hair washing device of claim 1 wherein the rotating disc is comprised of a plurality of jets.

4. The automatic hair washing device of claim 1 wherein the liquid is comprised of water and wherein the device further comprises a temperature control device for controlling the temperature of the water.

5. The automatic hair washing device of claim 1 wherein the hood comprises a flexible face cover for covering the hair and ears of the user while exposing the face of the user.

6. The automatic hair washing device of claim 5 wherein the cover forms an elastic inner edge for covering the hair and ears of the user.

7. The automatic hair washing device of claim 1 wherein the hood is hinged to the basin.

8. The automatic hair washing device of claim 1 wherein the hood comprises an outer edge having a soft sealing surface which forms a water tight seal with a surface of the basin and with the neck of the user.

9. The automatic hair washing device of claim 1 wherein the basin comprises an angled neck support configured to receive the neck of the user.

10. The automatic hair washing device of claim 9 wherein a surface of the neck support is inclined at an angle of about 45 degrees from the horizontal.

11. The automatic hair washing device of claim 10 wherein the neck support comprises a covering material which forms a liquid seal between the neck of the user and the covering material.

12. The automatic hair washing device of claim 11 wherein the covering material is formed from a soft flexible material.

* * * * *